US008635872B2

(12) United States Patent
Mayer et al.

(10) Patent No.: US 8,635,872 B2
(45) Date of Patent: Jan. 28, 2014

(54) PYROTECHNICAL ACTUATOR

(75) Inventors: Willibald Mayer, Feucht (DE); Friedrich Bertram, Schwaig (DE); Wolfgang Mosig, Hartmannshof (DE); Erich Muskat, Roth (DE)

(73) Assignee: Ruag Ammotec GmbH, Furth (DE)

( * ) Notice: Subject to any disclaimer, the term of this patent is extended or adjusted under 35 U.S.C. 154(b) by 990 days.

(21) Appl. No.: 12/677,929

(22) PCT Filed: Sep. 11, 2008

(86) PCT No.: PCT/EP2008/062057

§ 371 (c)(1),
(2), (4) Date: Mar. 12, 2010

(87) PCT Pub. No.: WO2009/037185

PCT Pub. Date: Mar. 26, 2009

(65) Prior Publication Data

US 2010/0307152 A1 Dec. 9, 2010

(30) Foreign Application Priority Data

Sep. 14, 2007 (DE) ..... 10 2007 044 076

(51) Int. Cl.
*F01B 29/08* (2006.01)

(52) U.S. Cl.
USPC ..... 60/632

(58) Field of Classification Search
USPC ..... 60/632–638
See application file for complete search history.

(56) References Cited

U.S. PATENT DOCUMENTS

| | | | | |
|---|---|---|---|---|
| 4,339,638 | A * | 7/1982 | Lascelles et al. | 200/52 R |
| 4,612,029 | A * | 9/1986 | Kramer et al. | 65/59.24 |
| 5,576,509 | A * | 11/1996 | Refouvelet et al. | 102/202.7 |
| 6,672,215 | B2 * | 1/2004 | Daoud | 102/202.14 |
| 6,915,744 | B2 * | 7/2005 | Tirmizi | 102/202.9 |

FOREIGN PATENT DOCUMENTS

| | | |
|---|---|---|
| EP | 1469205 | 10/2004 |

* cited by examiner

*Primary Examiner* — Hoang Nguyen
(74) *Attorney, Agent, or Firm* — Antonelli, Terry, Stout & Kraus, LLP.

(57) ABSTRACT

The invention relates to an actuator with a housing (1) in which a piston (2) with a pin (3) is inserted in a longitudinally displaceable manner, and with an igniting element (4) with contact pins (5), wherein the contact pins (5) project out of the housing (1) on the connecting side (6) thereof, and, when the igniting element (4) is ignited by the propellants generated, the piston (2) is displaced in the direction of the actuating side (7) until the pin (3) projects out of the housing (1) on the actuating side (7). For production to be more cost-effective, it is proposed that the housing (1) is designed as a single part and in the form of a cylinder, and the connecting side (6) is injection moulded or bonded around the end surface (9) of the housing (1) with a cylindrical cover (10) fitting thereover.

10 Claims, 1 Drawing Sheet

PYROTECHNICAL ACTUATOR

Figure 1:
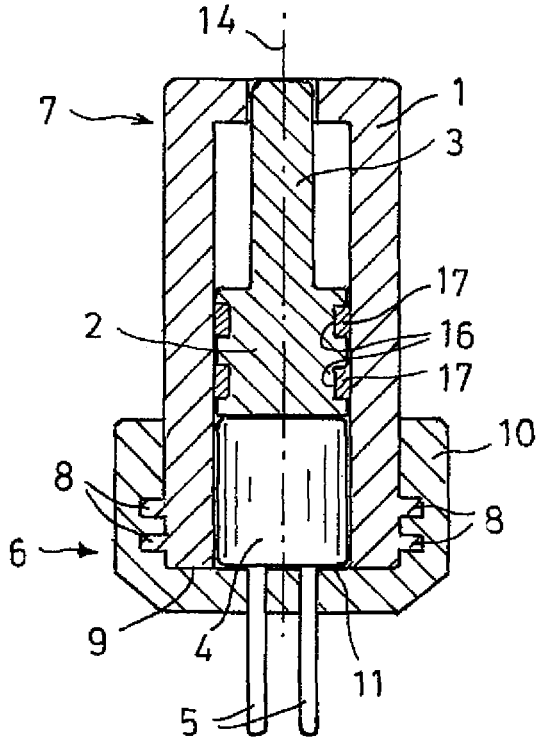

The invention relates to an actuator with a housing in which a piston with a pin is inserted in a longitudinally displaceable manner, and with an igniting element with contact pins, wherein the contact pins project out of the housing on the connecting side thereof, and, when the igniting element is ignited by the propellants generated, the piston is displaced in the direction of the actuating side until the pin projects out of the housing on the actuating side.

In actuators of this kind the housing comprises a support ring that carries the igniting element. The manufacture involves a relatively high level of complexity but offers the advantage of great mechanical stability.

The object of the present invention consists in proposing an actuator according to the state of the art in a manner that will allow for a production at reasonable cost. Furthermore, a method for the production of said actuator shall be described.

According to the invention this object is achieved by configuring the housing as a single part and in the shape of a cylinder, and with the connecting side being injection-molded or bonded around the end surface of the housing by a cylindrical cover fitting thereover. This way, the support ring that is customary in the state of the art is no longer necessary. The number of parts is thus reduced.

Preferably, radial expansions are provided on the outer circumference of the housing on the connecting side, which are molded or bonded around it. This way, the cover is securely fixed in placed on the housing.

Preferably, the igniting element is inserted up to the contact pins into the housing on the connecting side.

In one embodied example according to the invention the floor of the igniting element, from which the contact pins extend, is configured in alignment with the end surface of the housing. In this instance the floor of the igniting element and the end surface of the housing constitute a single area.

In the non-actuated state of the actuator the piston preferably rests against the igniting element. The delivery state, before the igniting element has been triggered, is designated as the non-actuated state.

In one embodied example the piston and the igniting element have the same diameter.

In another embodied example the diameter of the piston is smaller than the diameter of the igniting element.

In this context, preferably, the housing has a first bore hole, into which the igniting element is inserted, and a second bore hole, into which the piston is inserted with the pin; and whereby the first bore hole has a larger diameter than the second bore hole, and both bore holes are adjacent to each other in the longitudinal direction of the housing thus creating a shoulder against which the igniting element is supported.

Preferably, continuous grooves are arranged on the outer circumference of the piston, and sealing rings are inserted in said grooves.

A method according to the invention for the manufacture of the actuator is characterized in that, before molding around the housing on the connecting side with the cover, the piston and the igniting element are inserted into the housing, and during the molding process the igniting element is either fixed in place to the contact pins, or the piston is fixed in place and the igniting element is pressed against the piston or the shoulder.

The invention will subsequently be illustrated in more detail with the aid of two figures.

FIG. 1 shows a longitudinal view of an embodied example of an actuator according to the invention comprising a single-part cylinder-shaped housing 1. Single-part, when mentioned in the overall text, always refers to housing 1 without cover 10.

Housing 1 is open at its connecting side 6 making it possible to insert a piston 2 with a pin 3. Piston 2 has the same diameter as the inside diameter of housing 1. A bore hole is provided in the end surface on the actuating side 7 of the housing 1, and pin 3 is guided therein. Piston 2 has continuous grooves 16 on its outer circumference, and a sealing ring 17 is placed therein respectively, whereby piston 2 moves in a sealed fashion inside housing 1. When piston 2 moves from its starting position (only this position is shown in FIG. 1) to its end position, pin 3, which has a smaller inside diameter than housing 1, is displaced simultaneously causing pin 3 to project from housing 1 when piston 2 is in its end position. This serves to trigger a process mechanically.

Viewed from the actuating side 7, behind piston 2 there is an igniting element 4 inserted into housing 1. The end surface of the igniting element 4 rests against piston 2. Two contact pins 5 extend from floor 11 of igniting element 4 that serve to conduct the ignition current to ignition element 4. When ignition element 4 is triggered by an ignition current, a propellant gas develops, which displaces piston 2 and thereby pin 3 from connecting side 6 to actuating side 7. As a consequence, pin 3 protrudes to the outside of housing 1, which is used for control action.

Floor 11 of igniting element 4 is configured in alignment with end surface 9 of housing 1, whereby only contact pins 5 protrude to the outside of housing 1. A cover 10 is provided for closing housing 1, which is molded to connecting side 6. This cover 10 is molded or bonded around the former.

To lock cover 10 radial expansions 8 are provided on the connecting side on the outer circumference of housing 1. These expansions 8 are configured, for example, as continuous along the outer circumference. Connecting side 6 is thereby surround-molded or -bonded by end surface 9 of housing 1 and with expansions 8 of cylinder-shaped cover 10. Only contact the pins 5 project from the cover 10.

Therefore, the actuator shown in FIG. 1 comprises only four parts, i.e. housing 1, piston 2 with pin 3, igniting element 4 and cover 10, which makes it cost-effective in its production.

Figure 2:
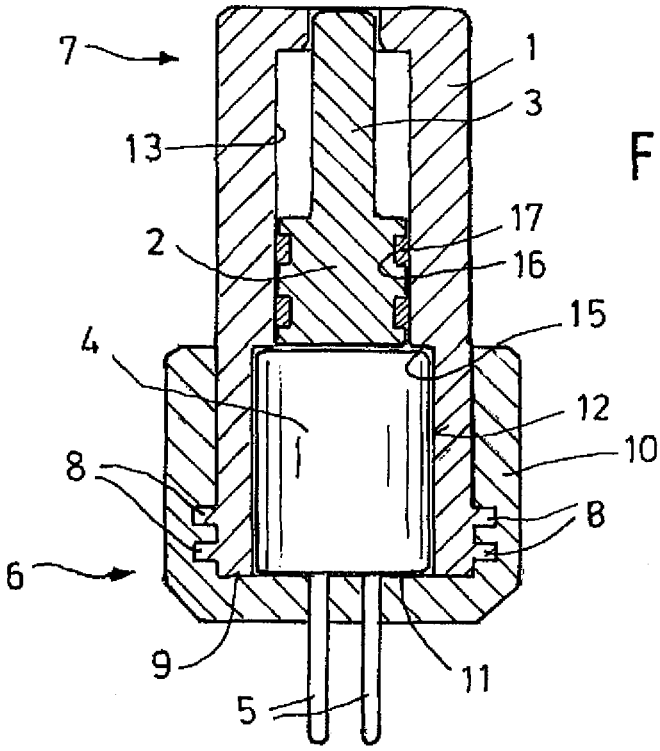

FIG. 2 shows a longitudinal view of an alternative embodied example of an actuator according to the invention. In this embodied example, housing 1 has a first bore hole 12, into which the igniting element 4 is inserted, and a second bore hole 13, into which piston 2 with pin 3 is inserted, and wherein the first bore hole 12 has a larger diameter than the second bore hole 13. Both bore holes 12, 13 are adjacent to each other in the longitudinal direction 14 of housing 1, thereby creating shoulder 15 against which igniting element 4 is supported. Regarding expansions 8 and cover 10, this embodied example is identical to the embodied example in FIG. 1.

Subsequently a method for the manufacture of the above-named actuator is described by way of two options. Both options provide that, in a first method step, piston 2 and igniting element 4 are inserted into housing 1 before the molding-around step with cover 10.

During molding, the igniting element 4 is either fixed in place to contact pins 5, whereafter cover 10 is molded around housing 1 (for the production of an actuator according to FIG. 1); or piston 2 is fixed in place and igniting element 4 is pushed onto piston 2 or shoulder 15, and then cover 10 is molded around housing 1 (for the production of an actuator according to FIG. 2.).

The invention claimed is:

1. An actuator, comprising:

a housing, comprising a single part in the shape of a hollow cylinder, having a connecting end and an actuating end;

a hollow cylinder-shaped cover, molded or bonded around the connecting end of the housing;

a piston with a pin, disposed in the housing, and displaceable in a longitudinal direction of the housing; and an igniting element with contact pins, aligned in a longitudinal direction of the housing;

wherein at least a portion of the contact pins of the igniting element project out beyond both the cylindrical cover and the connecting end of the housing;

wherein before the igniting element is ignited, the pin of the piston does not project out beyond the actuating end of the housing; and wherein when the igniting element is ignited, propellants generated by ignition of the igniting element displace the piston in the direction of the actuating end of the housing, until the pin of the piston projects out beyond the actuating end of the housing.

2. The actuator as claimed in claim 1, wherein on the connecting end, radial expansions are provided on the outer circumference of the housing that are also injection-molded or bonded around the housing.

3. The actuator as claimed in claim 1, wherein the igniting element is inserted, up to the contact pins, into the connecting end of the housing.

4. The actuator as claimed in claim 1, wherein the floor of the igniting element, from which the contact pins project, is configured in alignment with end surface of the connecting end of the housing.

5. The actuator as claimed in claim 1, wherein in the non-active state of the actuator, the piston rests against the igniting element.

6. The actuator as claimed in claim 1, wherein the piston and the igniting element have the same diameter.

7. The actuator as claimed in claim 1, wherein the diameter of piston is smaller than the diameter of the igniting element.

8. The actuator as claimed in claim 7, wherein the housing has a first bore hole, into which the igniting element is inserted, and a second bore hole, into which the piston with the pin is inserted;

wherein the first bore hole has a larger diameter than the second bore hole; and wherein both bore holes are adjacent to each other in longitudinal direction of the housing, thereby creating a shoulder against which the igniting element is supported.

9. The actuator as claimed in claim 1, wherein continuous grooves are provided on the outer circumference of pistons, the continuous grooves having sealing rings inserted therein.

10. A method for the production of an actuator as claimed in claim 1, wherein before molding the cover around the connecting end of the housing, the piston and the igniting element are inserted into the housing and, during the molding process, either: the igniting element is fixed in place to the contact pins, or the piston is fixed in place and the igniting element is pressed onto the piston or the shoulder.

* * * * *